US011170958B2

(12) United States Patent
Tsurusu et al.

(10) Patent No.: US 11,170,958 B2
(45) Date of Patent: Nov. 9, 2021

(54) HIGH FREQUENCY RELAY

(71) Applicant: Omron Corporation, Kyoto (JP)

(72) Inventors: Tetsuro Tsurusu, Takatsuki (JP); Masaaki Abe, Kumamoto (JP); Tsuyoshi Okubo, Kikuchi (JP); Yuki Honda, Kumamoto (JP)

(73) Assignee: Omron Corporation, Kyoto (JP)

( * ) Notice: Subject to any disclaimer, the term of this patent is extended or adjusted under 35 U.S.C. 154(b) by 185 days.

(21) Appl. No.: 16/490,113

(22) PCT Filed: Dec. 14, 2017

(86) PCT No.: PCT/JP2017/044906
§ 371 (c)(1),
(2) Date: Aug. 30, 2019

(87) PCT Pub. No.: WO2018/168134
PCT Pub. Date: Sep. 20, 2018

(65) Prior Publication Data

US 2020/0020496 A1 Jan. 16, 2020

(30) Foreign Application Priority Data

Mar. 13, 2017 (JP) ..... JP2017-047757

(51) Int. Cl.
*H01H 13/04* (2006.01)
*H01H 50/04* (2006.01)
(Continued)

(52) U.S. Cl.
CPC ..... *H01H 50/041* (2013.01); *H01H 50/10* (2013.01); *H01H 50/14* (2013.01); *H01H 2239/004* (2013.01)

(58) Field of Classification Search
CPC ..... H01H 50/041; H01H 50/10; H01H 50/14; H01H 2239/004; H01H 50/02
(Continued)

(56) References Cited

U.S. PATENT DOCUMENTS 5,994,986 A * 11/1999 Takahashi ..... H01H 51/2272 335/128
6,130,592 A 10/2000 Okihara
(Continued)

FOREIGN PATENT DOCUMENTS

JP S56-100852 U 8/1981
JP H10-199388 A 7/1998
(Continued)

OTHER PUBLICATIONS

International Search Report issued in Application No. PCT/JP2017/044906, dated Mar. 20, 2018 (1 page).
(Continued)

*Primary Examiner* — Shawki S Ismail
*Assistant Examiner* — Lisa N Homza
(74) *Attorney, Agent, or Firm* — Osha Bergman Watanabe & Burton LLP

(57) ABSTRACT

A high frequency relay is provided with an insulating outer housing, a relay body including an electromagnet unit and a contact mechanism unit, and a shield member. The relay body has a plate-like relay terminal, and the relay terminal is disposed such that the plate surfaces of the relay terminal extend along second surfaces of the relay body and one of the plate surfaces is exposed from at least one of the second surfaces. On the second surface, an insulator capable of insulating the relay terminal and the shield member is provided between the plate surface of the relay terminal and the shield member.

4 Claims, 6 Drawing Sheets

(51) Int. Cl.
*H01H 50/10* (2006.01)
*H01H 50/14* (2006.01)

(58) Field of Classification Search
USPC ..... 335/202
See application file for complete search history.

(56) References Cited

U.S. PATENT DOCUMENTS

| | | | | |
|---|---|---|---|---|
| 6,288,622 | B1 | 9/2001 | Okihara | |
| 7,872,551 | B2 * | 1/2011 | Nakamura | H01H 50/54 335/4 |
| 2002/0121950 | A1 * | 9/2002 | Kadoya | H01H 50/10 335/78 |
| 2003/0080840 | A1 * | 5/2003 | Nakamura | H01H 50/10 335/128 |
| 2010/0052830 | A1 * | 3/2010 | Shinoura | H01H 43/022 335/202 |
| 2018/0144892 | A1 * | 5/2018 | Shimoda | H01L 23/66 |

FOREIGN PATENT DOCUMENTS

| | | | |
|---|---|---|---|
| JP | H11-144592 | A | 5/1999 |
| JP | 2003-132774 | A | 5/2003 |

OTHER PUBLICATIONS

Written Opinion issued in International Application No. PCT/JP2017/044906, dated Mar. 20, 2018 (8 pages).

* cited by examiner

HIGH FREQUENCY RELAY

TECHNICAL FIELD

The present disclosure relates to a high frequency relay.

BACKGROUND ART

Patent Document 1 discloses a high frequency relay that includes a relay body having, on the inside, a contact mechanism unit in which a contact state is switched in accordance with the energization of a coil and which is provided such that a terminal electrically connected to the contact mechanism unit projects from the bottom surface. In this high frequency relay, an isolation characteristic is improved by covering the relay body with a base and a lid each including a conductor layer with a grounding function.

PRIOR ART DOCUMENT

Patent Document

Patent Document 1 Japanese Unexamined Patent Publication No. 2003-132774

SUMMARY OF THE INVENTION

Problems to be Solved by the Invention

However, since the high frequency relay is intended to improve the isolation characteristic which is the degree of leakage of high frequency signal between contacts in a contact-off state, the improvement in other high frequency characteristics is not considered. For this reason, in the high frequency relay, it is difficult to reduce variation in characteristic impedance and improve high frequency characteristics.

Therefore, it is an object of the present disclosure to provide a high frequency relay that reduces variation in characteristic impedance and has excellent high frequency characteristics.

Means for Solving the Problem

An example of a high frequency relay of the present disclosure is a high frequency relay including: an insulating outer housing that includes a base having a relay body mounting surface, and a box-shaped case covering the relay body mounting surface; a relay body provided inside the outer housing and on the relay body mounting surface of the base, and including an electromagnet unit and a contact mechanism unit, the electromagnet unit being able to be supplied with a current, the contact mechanism unit being opened and closed by supplying a current to the electromagnet unit; and a shield member provided inside the outer housing and on the relay body mounting surface of the base, and configured to cover the relay body. The relay body has a first surface facing the relay body mounting surface of the base, a plurality of second surfaces extending in a direction intersecting the first surface and covered with the shield member, and at least one plate-like relay terminal extending from at least one of the plurality of second surfaces of the relay body to an outside of the outer housing through the base in a direction intersecting the relay body mounting surface, the relay terminal being electrically connected to the contact mechanism unit. The relay terminal is disposed such that plate surfaces of the relay terminal extend along at least one of the plurality of second surfaces of the relay body, and one of the plate surfaces is exposed from the second surface. On the second surface, an insulator capable of insulating the relay terminal and the shield member is provided between the plate surface of the relay terminal and the shield member.

Effect of the Invention

According to the high frequency relay, the insulator capable of insulating the relay terminal and the shield member is provided between the plate surface of the relay terminal and the shield member. That is, with the insulator, the relay terminal and the shield member are disposed with a space therebetween while insulated from each other. It is thereby possible to reduce variation in characteristic impedance and enhance high frequency characteristics.

MODE FOR CARRYING OUT THE INVENTION

Hereinafter, one embodiment of the present disclosure will be described with reference to the accompanying drawings. In the following description, terms indicating specific directions or positions (e.g., terms including "upper", "lower", "right", and "left") are used as necessary. However, these terms are used to facilitate understanding of the invention with reference to the drawings, and the meanings of the terms do not limit the technical scope of the present disclosure. The following description is merely exemplary in nature and not intended to limit the present disclosure, its application, or its usage. Further, the drawings are schematic, and ratios of dimensions or the like do not necessarily agree with actual ones.

Figure 1:
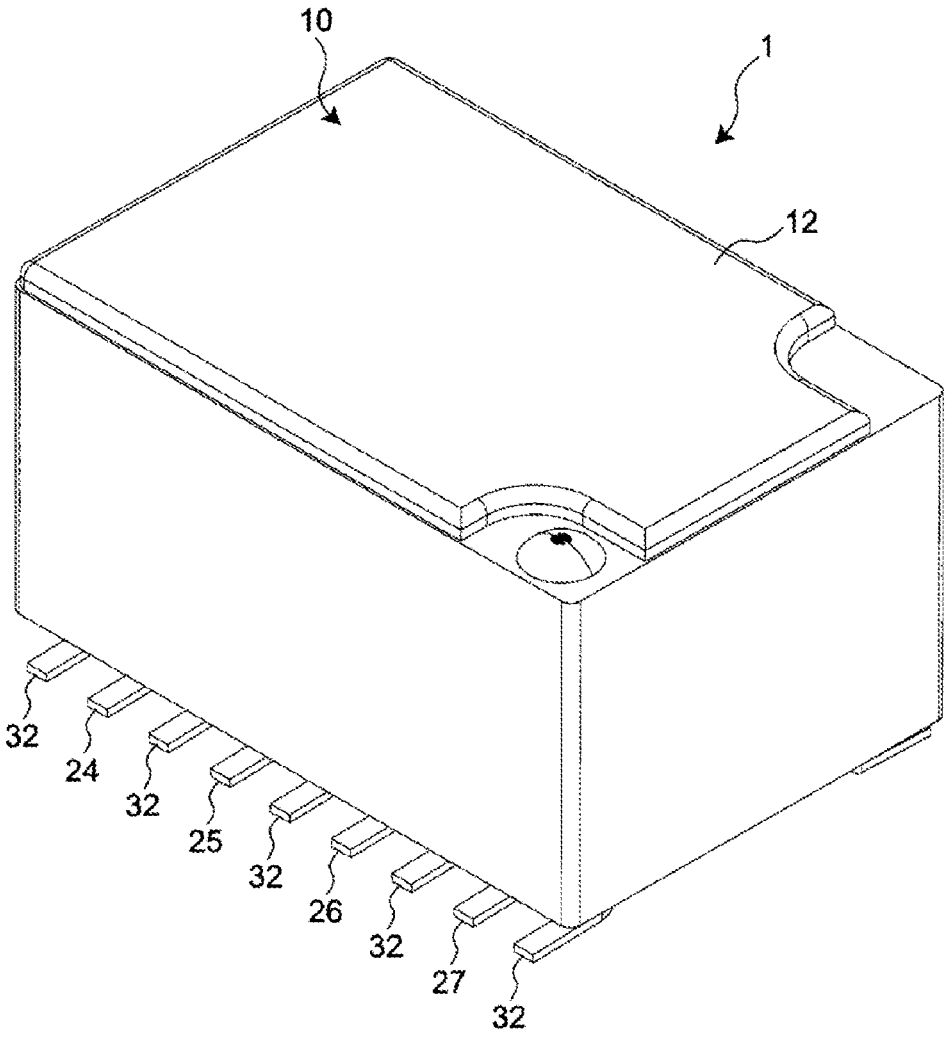
FIG. 1 is a perspective view illustrating a high frequency relay according to an embodiment of the present disclosure.
Figure 2:
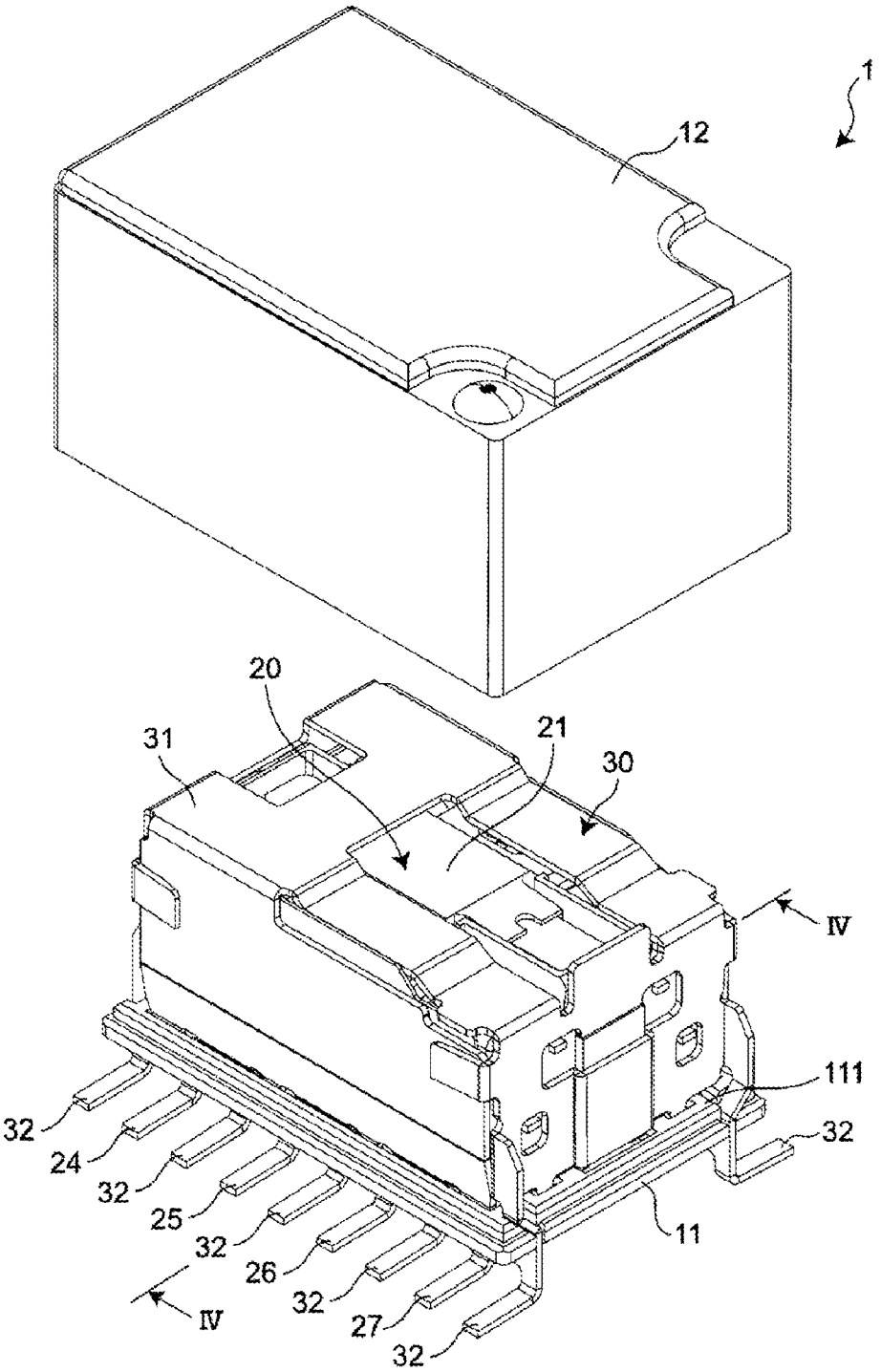
FIG. 2 is a perspective view illustrating a state in which a case has been removed from the high frequency relay of FIG. 1.

As illustrated in FIGS. 1 and 2, a high frequency relay 1 according to an embodiment of the present disclosure is provided with an insulating outer housing 10, a relay body 20 provided inside the outer housing 10, and a shield member 30

As illustrated in FIG. 2, the outer housing 10 includes a base 11 having a relay body mounting surface 111 and a case 12 covering the relay body mounting surface 111 of the base 11. The base 11 and the case 12 are made of insulating resin and sealed by a sealing material (not illustrated).

As illustrated in FIG. 2, the base 11 has a substantially rectangular shape in a plan view along a direction orthogonal to the relay body mounting surface 111. At each of both side edges extending in the longitudinal direction of the relay body mounting surface 111 of the base 11 (only one side edge is illustrated in FIG. 2), as an example, four first terminal grooves 112 and five fifth terminal grooves 113 are provided. The first terminal groove 112 and the second terminal groove 113 penetrate the base 11 in the direction orthogonal to the relay body mounting surface 111 of the base 11. Further, the first terminal groove 112 and the second terminal groove 113 are aligned along a side extending in the longitudinal direction of the base 11 and arranged such that one first terminal groove is positioned between two adjacent second terminal grooves 113.

In each of the first terminal grooves 112 and each of the second terminal grooves 113, the length in the short direction of the base 11 (i.e., the groove widths) is substantially the same in a plan view along the direction orthogonal to the relay body mounting surface 111. However, the length in the longitudinal direction of the base 11 (i.e., the groove length) is longer in the second terminal groove 113 than in the first terminal groove 112.

As illustrated in FIG. 2, the case 12 has a rectangular hollow box shape with one surface opened and can cover the relay body mounting surface 111 of the base 11.

Figure 3:
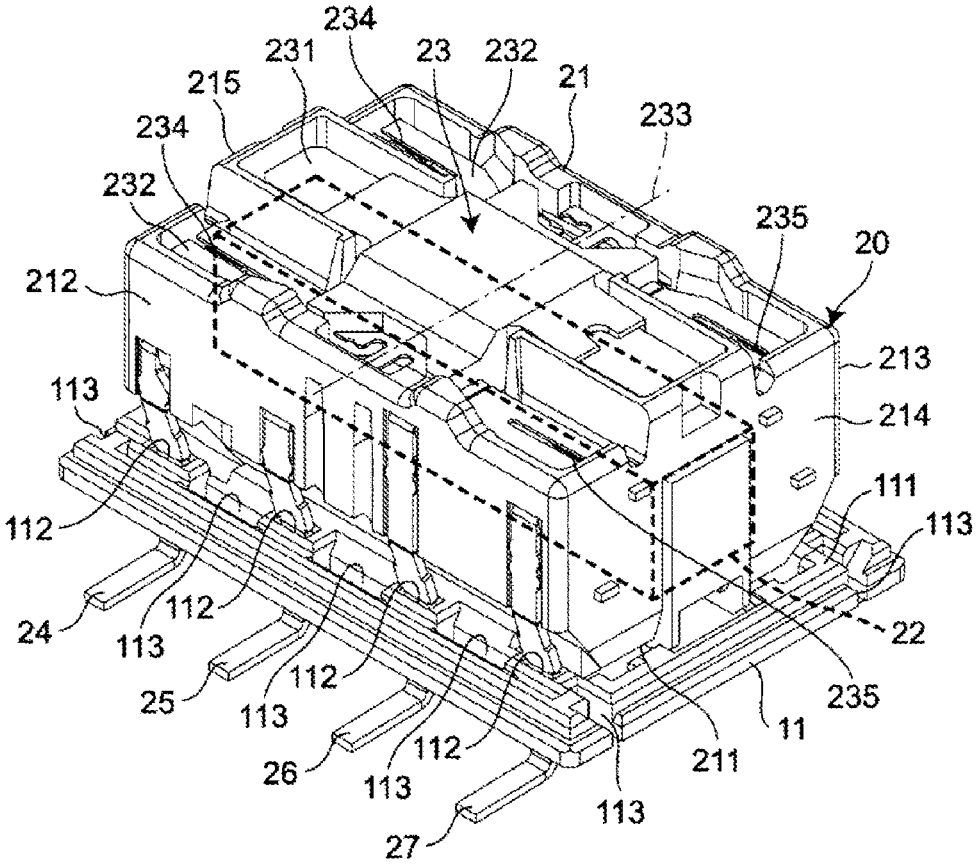
FIG. 3 is a perspective view illustrating an electromagnet unit and a contact mechanism unit of a relay body in the high frequency relay of FIG. 1.

As illustrated in FIG. 3, the relay body 20 is provided inside the outer housing 10 and on the relay body mounting surface 111 of the base 11. The relay body 20 includes an inner housing 21 having a substantially rectangular parallelepiped shape, an electromagnet unit 22 provided in the inner housing 21 and capable of supplying current, and a contact mechanism unit 23 opened and closed by supplying a current to the electromagnet unit 22.

A pair of plate-like coil terminals 24 (only one of which is illustrated in FIG. 3) is electrically connected to the electromagnet unit 22, and a current is supplied through the pair of coil terminals 24. Assuming that the surface of the inner housing 21 of the relay body 20 which faces the relay body mounting surface 111 of the base 11 is a first surface 211 and that four surfaces intersecting the first surface 211 are second surfaces 212, 213, 214, 215, each coil terminal 24 extends from the second surfaces 212, 213 extending in the longitudinal direction of the inner housing 21 among the four second surfaces 212, 213, 214, 215 to the outside of the outer housing 10 through the base 11 in the direction intersecting the relay body mounting surface 111 of the base 11. Note that the pair of coil terminals 24 is inserted in the first terminal groove 112 disposed at one end in the longitudinal direction of the relay body mounting surface 111 of the base 11.

Figure 4:
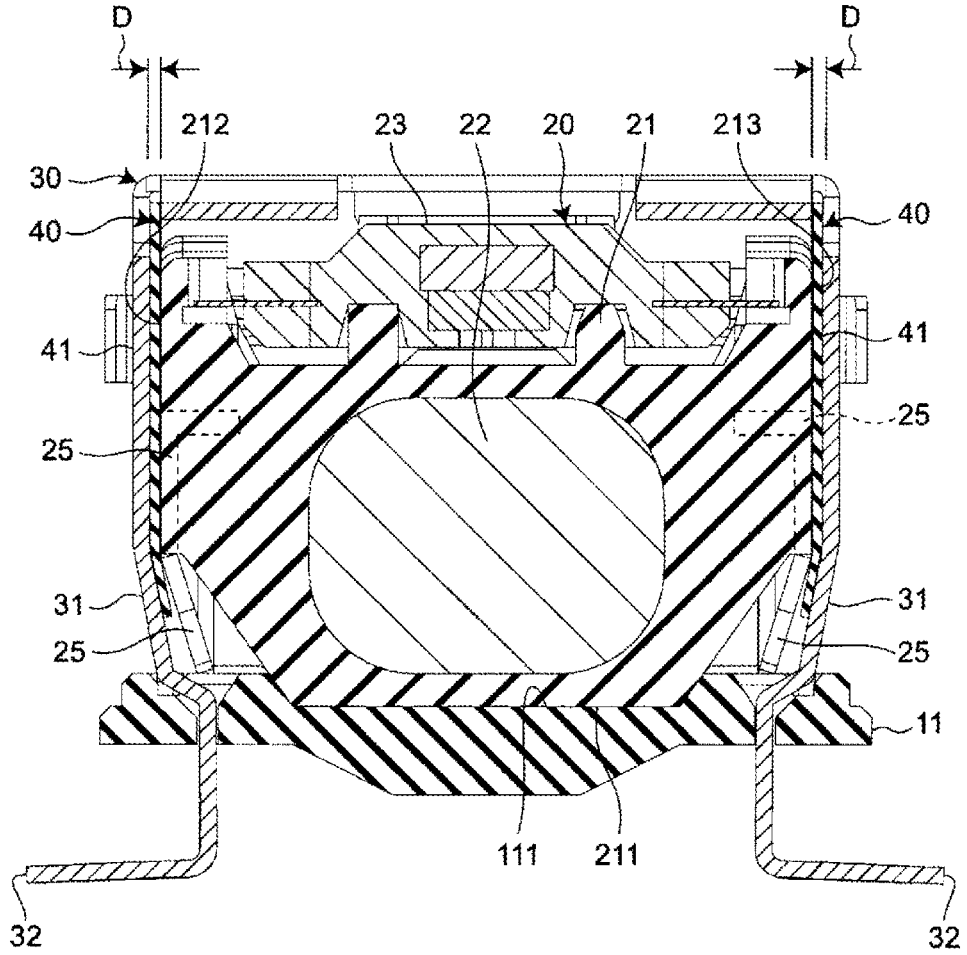
FIG. 4 is a sectional view taken along line IV-IV in FIG. 2.

As illustrated in FIG. 4, the contact mechanism unit 23 has, on the upper surface of the inner housing 21 (i.e., the upper surface in FIG. 4), a rectangular plate-like movable iron piece 231 disposed substantially at the center in the short direction of the inner housing 21 and extending in the longitudinal direction of the inner housing 21, and a pair of rectangular plate-like movable contact pieces 232 disposed on both sides in the short direction of the movable iron piece 231.

The movable iron piece 231 can be rotated about a rotary shaft 233 extending at the center in the longitudinal direction of the inner housing 21 and in the short direction of the inner housing 21 by supplying a current to the electromagnet unit 22. By the rotation of the movable iron piece 231, the movable contact piece 232 is rotated about the rotary shaft 233 in the same direction as the movable iron piece 231. A first movable contact 234 and a second movable contact 235 are provided at both longitudinal ends of the surface of the movable iron piece 231 which faces the base 11.

In addition, the contact mechanism unit 23 has three pairs of plate-like relay terminals 25, 26, 27 (only one of each pair is illustrated in FIG. 3) penetrating the base 11 from the inside of the inner housing 21 through the second surface 212 in the direction intersecting the relay body mounting surface 111 of the base 11 and extending to the outside of the outer housing 10, the relay terminals 25, 26, 27 being disposed on both sides of the housing 21 in the short direction.

As illustrated in FIG. 4, each of the relay terminals 25, 26, 27 has the plate surface extending along the longitudinal direction of the inner housing 21 (in other words, extending substantially parallel to the second surfaces 212, 213 facing the short direction of the inner housing 21) and is inserted in the corresponding first terminal groove 112 of the relay body mounting surface 111 of the base 11. One of the plate surfaces of each of the relay terminals 25, 26, 27 is exposed from the second surface 212. Further, the tips of the respective relay terminals 25, 26, 27 are bent in the short direction of the base 11 and extend in the direction away from the base 11.

Of the three pairs of relay terminals 25, 26, 27, the pair of relay terminals 25 disposed near the coil terminal 24 is electrically connected to a fixed contact (not illustrated) facing the first movable contact 234 of the movable contact piece 232 in a contactable or detachable manner. Of the three pairs of relay terminals 25, 26, 27, the pair of relay terminals 27 disposed most distant from the coil terminal 24 is electrically connected to a fixed contact (not illustrated) facing the second movable contact 235 of the movable contact piece 232 in a contactable or detachable manner. Further, the pair of relay terminals 26 positioned in the middle of the three pairs of relay terminals 25, 26, 27 is electrically connected to the movable contact piece 232. That is, each of the relay terminals 25, 26, 27 is electrically connected to the contact mechanism unit 23.

The shield member 30 is made of, for example, a metal plate, and as illustrated in FIG. 2, the shield member 30 includes a shield body 31 covering the relay body 20, and five pairs of ground terminals 32 extending from the shield body 31 to the outside of the outer housing 10 through the base 11 in the direction intersecting with the relay body mounting surface 111.

The shield body 31 has a hollow rectangular plate shape along the outer shape of the inner housing 21 of the relay body 20. Further, the ground terminals 32 are respectively provided on both sides in the short direction of the shield body 31 and are arranged in parallel with and adjacent to the relay terminals 25, 26, 27, respectively.

Further, as illustrated in FIG. 4, on the second surfaces 212, 213 extending in the longitudinal direction of the inner housing 21 of the relay body 20, an insulator 40 capable of insulating the relay terminals 25, 26, 27 and the shield member 30 is provided between the plate surfaces of the relay terminals 25, 26, 27 (only the relay terminal 25 is illustrated in FIG. 4) and the shield member 30 of the shield body 31.

Figure 5:
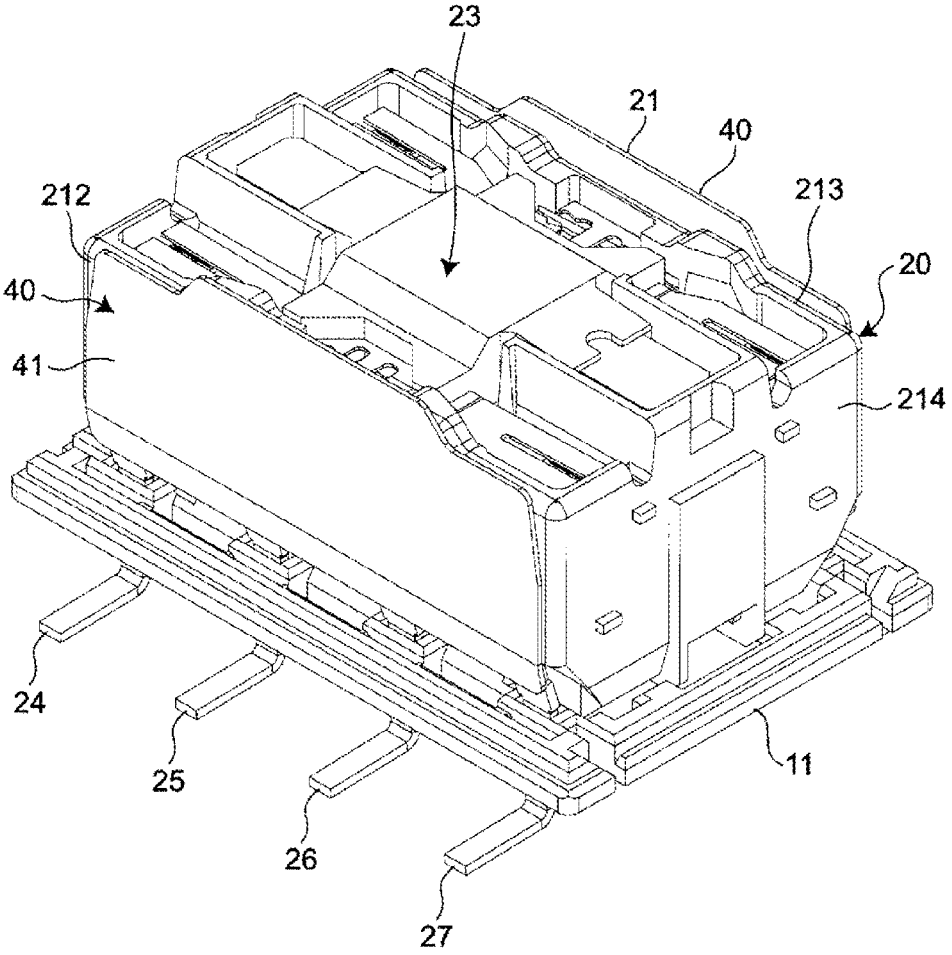
FIG. 5 is a perspective view of the relay body in the high frequency relay of FIG. 1.

The insulator 40 is, for example, an insulating sheet 41 made of Teflon (registered trademark) and having a thickness of 0.08 mm, and is disposed so as to cover the second surfaces 212, 213 extending in the longitudinal direction of the inner housing 21 as illustrated in FIG. 5. Note that the material of the insulating sheet 41 is determined in accordance with the design of the high frequency relay 1 and the like.

According to the high frequency relay 1, the insulator 40 which can insulate the relay terminals 25, 26, 27 and the shield member 30 is provided between the plate surfaces of the relay terminals 25, 26, 27 and the shield body 31 of the shield member 30/ That is, with the insulator 40, each of the relay terminals 25, 26, 27 and the shield member 30 are disposed with at least a space D (illustrated in FIG. 4) while insulated from each other. Thus, the space D can be adjusted by adjusting the thickness of the insulating sheet 41 of the insulator 40, so that variation in characteristic impedance can be reduced to enhance high frequency characteristics.

In addition, since the insulator 40 is, for example, the insulating sheet 41 having a constant thickness, each of the relay terminals 25, 26, 27 and the shield member 30 can be easily disposed with a space D therebetween while insulated from each other.

Figure 6:
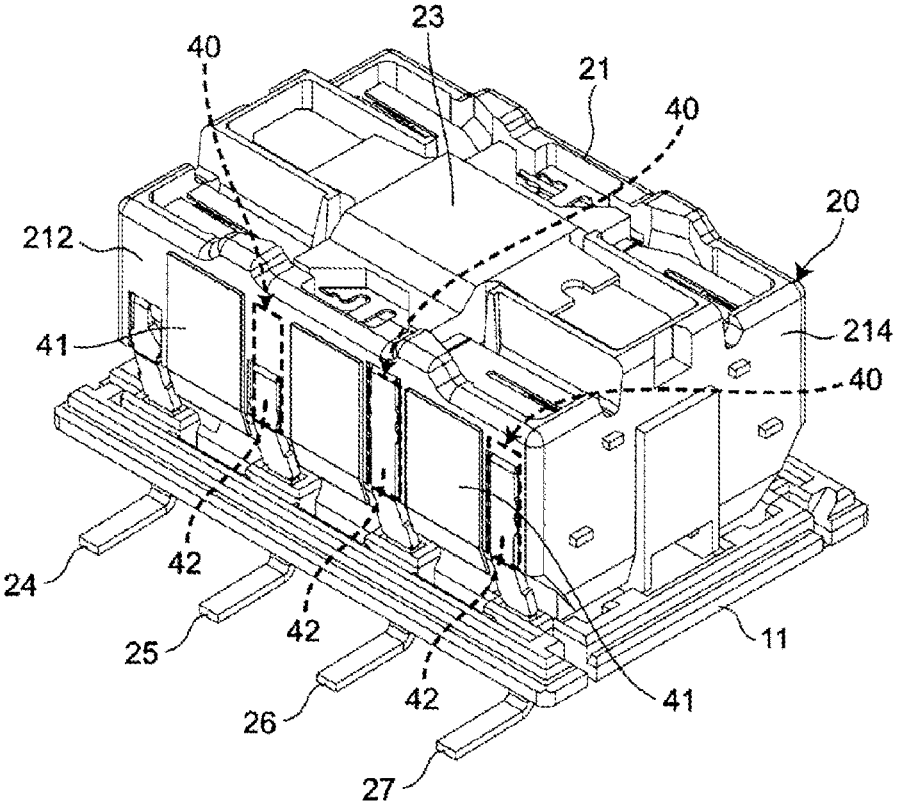
FIG. 6 is a perspective view illustrating another example of an insulator in the high frequency relay of FIG. 1.

Note that the insulator 40 is not limited to the insulating sheet 41. For example, as illustrated in FIG. 6, the insulator 40 may be an insulating space 42 having a gap of at least the space D or larger. In this case, a spacer (here, the insulating sheet 41) may be provided on each of the second surfaces 212, 213 extending in the longitudinal direction of the inner housing 21 except for the vicinity of the relay terminals 25, 26, 27 so that each of the relay terminals 25, 26, 27 and the shield member 30 are disposed with a space D therebetween while insulated from each other. In this case, since it is not necessary to provide an insulating sheet for insulation between each of the relay terminals 25, 26, 27 and the shield member 30, the manufacturing cost can be reduced to enhance the productivity.

Further, although not illustrated, the insulator 40 may be an insulating resin layer that is provided on the inner surface of the shield body 31 of the shield member 30, facing the plate surfaces of the relay terminals 25, 26, 27, and has a substantially constant thickness D. In this case, for example, the insulating resin layer is formed integrally with the shield body 31 on the inner surface of the shield body 31 by insert molding or the like to eliminate the need for attaching an insulating sheet or the like. Therefore, the manufacturing process can be reduced to enhance the productivity. In addition to the insert molding, the insulating resin layer may be formed by laminating and coating the inner surface of the shield body 31 with a resin film, may be formed on the inner surface of the shield body 31 by three-dimensional molding which is used for a flexible printed circuit (FPC), or may be formed on the inner surface of the shield body 31 by using a 3D printer.

As described above, the insulator 40 may only be placed with each of the relay terminals 25, 26, 27 and the shield member 30 disposed with the space D therebetween while insulated from each other, and any configuration can be adopted in accordance with the design of the high frequency relay 1 and the like.

The space D is determined in accordance with the design of the high frequency relay 1 and the like, and is not limited to 0.1 mm. In addition, the space D is not limited to a substantially constant value and may, for example, regularly or randomly vary between 0.1 mm and 0.2 mm.

The relay terminals 25, 26, 27 and the ground terminal 32 may be at least one each. A freely selected number of relay terminals and ground terminals can be provided depending on the design of the high frequency relay and the like.

A variety of embodiments of the present disclosure have been described in detail with reference to the drawings, and lastly, a variety of aspects of the present disclosure will be described. In the following description, as an example, reference symbols are also attached.

A high frequency relay 1 of a first aspect of the present disclosure is a high frequency relay provided with: an insulating outer housing 10 that includes a base 11 having a relay body mounting surface 111 and includes a box-shaped case 12 covering the relay body mounting surface 111; a relay body 20 provided inside the outer housing 10 and on the relay body mounting surface 111 of the base 11 and including an electromagnet unit 22 and a contact mechanism unit 23; the electromagnet unit 22 being able to be supplied with a current, the contact mechanism unit 23 being opened and closed by supplying a current to the electromagnet unit 22; and a shield member 30 provided inside the outer housing 10 and on the relay body mounting surface 111 of the base 11, the shield member 30 being configured to cover the relay body 20. The relay body 20 has a first surface 211 facing the relay body mounting surface 111 of the base 11, a plurality of second surfaces 212, 213, 214, 215 extending in a direction intersecting the first surface 211 and covered with the shield member 30, and at least one plate-like relay terminal 25, 26, 27 extending from at least one of the second surfaces 212, 213, 214, 215 of the relay body 20 to the outside of the outer housing 10 through the base 11 in the direction intersecting the relay body mounting surface 111, the relay terminal 25, 26, 27 being electrically connected to the contact mechanism unit 23. The relay terminal 25, 26, 27 is disposed such that plate surfaces of the relay terminal 25, 26, 27 extend along at least one of the second surfaces 212, 213, 214, 215 of the relay body 20, and one of the plate surfaces is exposed from the second surface 212, 213, 214, 215. On the second surface 212, 213, 214, 215, an insulator 40 capable of insulating the relay terminal 25, 26, 27 and the shield member 30 is provided between the plate surface of the relay terminal 25, 26, 27 and the shield member 30.

In the high frequency relay 1 of the first aspect, the insulator 40 capable of insulating the relay terminals 212, 213, 214, 215 and the shield member 30 is provided between the plate surfaces of the relay terminals 25, 26, 27 and the shield member 30. That is, with the insulator 40, each of the relay terminals 25, 26, 27 and the shield member 30 are disposed with a space therebetween while insulated from each other. It is thereby possible to reduce variation in characteristic impedance and enhance high frequency characteristics.

In the high frequency relay 1 of a second aspect of the present disclosure, the insulator 40 is an insulating sheet 41 that covers a plate surface of the relay terminal 25, 26, 27, the plate surface facing the shield member 30.

In the high frequency relay 1 according to the second aspect, each of the relay terminal 25, 26, 27 and the shield member 30 can be easily disposed at a space D while being insulated from each other.

In the high frequency relay 1 of a third aspect of the present disclosure, the insulator 40 is an insulating space 42 provided between the relay terminal 25, 26, 27 and the shield member 30.

In the high frequency relay 1 of the third aspect, since it is not necessary to provide an insulating sheet for insulation between each of the relay terminals 25, 26, 27 and the shield member 30, the manufacturing cost can be reduced to enhance the productivity.

In the high frequency relay 1 of a fourth aspect of the present disclosure, the insulator 40 is an insulating resin layer provided on an inner surface of the shield member 30, the inner surface facing the plate surface of the relay terminal 25, 26, 27.

In the high frequency relay 1 of the fourth aspect, for example, the insulating sheet 41 and the like need not be attached by integrally forming the shield member 30 and the insulating resin layer, so that the manufacturing process can be reduced and the productivity can be enhanced.

By appropriately combining freely selected embodiments or modified examples of the above variety of embodiments or modified examples, the respective effects of those combined can be exerted. While it is possible to combine embodiments, combine examples, or combine an embodiment and an example, it is also possible to combine features in different embodiments or examples.

While the present disclosure has been fully described in connection with the preferred embodiments with reference to the accompanying drawings, a variety of modified examples or corrections will be apparent to those skilled in the art. Such modifications or amendments are to be understood as being included in the scope of the present disclosure according to the appended claims so long as not deviating therefrom.

INDUSTRIAL APPLICABILITY

The high frequency relay of the present disclosure can be applied to, for example, a wireless relay device.

DESCRIPTION OF SYMBOLS

1 high frequency relay
10 outer housing
11 base
111 relay body mounting surface
112 first terminal groove
113 second terminal groove
12 case
20 relay body
21 inner housing
211 first surface
212, 213, 214, 215 second surface
22 electromagnet unit
23 contact mechanism unit
231 movable iron piece
232 movable touch piece
233 rotary shaft
234 first movable contact
235 second movable contact
24 coil terminal
25, 26, 27 relay terminal
30 shield member
31 shield body
32 ground terminal
40 insulator
41 insulating sheet
42 insulating space
D space

The invention claimed is:

1. A high frequency relay comprising:

an insulating outer housing that includes a base having a relay body mounting surface, and a box-shaped case covering the relay body mounting surface;

a relay body provided inside the outer housing and on the relay body mounting surface of the base, and including an electromagnet unit and a contact mechanism unit, the electromagnet unit being able to be supplied with a current, the contact mechanism unit being opened and closed by supplying the current to the electromagnet unit; and a shield member provided inside the outer housing and on the relay body mounting surface of the base, and configured to cover the relay body, wherein the relay body has:

a first surface facing the relay body mounting surface of the base, a plurality of second surfaces extending in a direction intersecting the first surface and covered with the shield member, and at least one plate-like relay terminal extending from at least one of the plurality of second surfaces of the relay body to an outside of the outer housing through the base in a direction intersecting the relay body mounting surface, the relay terminal being electrically connected to the contact mechanism unit, wherein the relay terminal is disposed such that plate surfaces of the relay terminal extend along at least one of the plurality of second surfaces of the relay body, and one of the plate surfaces is exposed from the second surface, and wherein on the second surface, an insulator that insulates the relay terminal and the shield member is provided between the plate surface of the relay terminal and the shield member.

2. The high frequency relay according to claim 1, wherein the insulator is an insulating sheet that covers the plate surface of the relay terminal, the plate surface facing the shield member.

3. The high frequency relay according to claim 1, wherein the insulator is an insulating space provided between the relay terminal and the shield member.

4. The high frequency relay according to claim 1, wherein the insulator is an insulating resin layer provided on an inner surface of the shield member, the inner surface facing the plate surface of the relay terminal.

* * * * *